US007179065B2

(12) United States Patent
Kim

(10) Patent No.: US 7,179,065 B2
(45) Date of Patent: Feb. 20, 2007

(54) LINEAR COMPRESSOR

(75) Inventor: Dong Han Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/191,902

(22) Filed: Jul. 29, 2005

(65) Prior Publication Data

US 2006/0076015 A1 Apr. 13, 2006

(30) Foreign Application Priority Data

Oct. 7, 2004 (KR) ..... 10-2004-0079942

(51) Int. Cl.
*F04B 17/04* (2006.01)
*F04B 35/04* (2006.01)

(52) U.S. Cl. ..... 417/417; 417/540; 417/551; 417/569; 417/570

(58) Field of Classification Search ..... 417/417, 417/540, 551, 569, 570; 137/543.17
See application file for complete search history.

(56) References Cited

U.S. PATENT DOCUMENTS 6,824,365 B2 * 11/2004 Park et al. ..... 417/312
2004/0247466 A1 * 12/2004 Lee et al. ..... 417/415

FOREIGN PATENT DOCUMENTS

KR 20020091634 12/2002

OTHER PUBLICATIONS

U.S. Appl. No. 11/165,189, Jung et al., filed Jun. 24, 2005.
English Language Abstract of KR 2002-0091634.

* cited by examiner

*Primary Examiner*—Henry Bennett
*Assistant Examiner*—Nihir Patel
(74) *Attorney, Agent, or Firm*—Greenblum & Bernstein, P.L.C.

(57) ABSTRACT

Disclosed herein is a linear compressor. In the present invention, a spring sheet is equipped in an exhale cover to prevent an edge and an outer circumference of an exhale spring from touching with the exhale cover. A surface of the spring sheet is treated with a metal of the high hardness, thereby protecting against its abrasion and transformation, caused by a repetitive load from the exhale spring. Furthermore, the durability is improved by enduring the excessive or local load from the exhale spring.

14 Claims, 5 Drawing Sheets

LINEAR COMPRESSOR

BACKGROUND OF THE INVENTION

1. Field of the Invention

The present invention relates to a linear compressor, more particularly, which is capable of preventing an exhale spring and an exhale cover from being abraded and from being transformed, caused by a load from the exhale spring.

2. Description of the Related Art

Generally, a linear compressor is a machine to inhale, to compress, and to discharge fluid by linearly reciprocating a piston within a cylinder, by means of linear driving force of a linear motor.

FIG. 1 shows the linear compressor, in accordance with the prior art, and FIG. 2 shows a structure of an exhale part of the linear compressor, in accordance with the prior art.

In a hermetic casing 2 of the conventional linear compressor, a cylinder block 4 provided with the cylinder 3 and a back cover 6 provided with an inlet 5 are equipped. The cylinder block 4 and the back cover 6 are upheld in the hermetic casing 2 by a main damper 7 and a subsidiary damper 8, so as to absorb a shock (see FIG. 1).

The linear motor 10 is mounted between the cylinder block 4 and the back cover 6, which generates driving force to compress fluid.

The linear motor 10 is divided by a stationary part and a movable part. The stationary part includes an outer core 11, an inner core 12, and a coil 13 with a magnetic field. The movable part includes a magnet 14 that linearly reciprocates by magnetic force around the coil 13, and a magnet frame 15 which the magnet 14 is fastened to.

The piston 16 is connected to the magnet frame 15, which receives linear driving force from the magnet 14, linearly reciprocates in the cylinder 3, and compresses fluid.

In a rear of the piston 16, a flange 17 is formed to be fixed to the magnet frame 15. A main spring 18 is disposed between the flange 17 and the cylinder block 4, and a subsidiary spring 19 is disposed between the flange 17 and the back cover 6, so that the piston 16 is elastically suspended.

The piston 16 is in the shape of a cylinder, which is open at its rear. An inhale passage 20 where fluid is entered is provided therein, and a plurality of inhale ports 21 is provided in its front.

In a front of the piston 16, there is an inhale valve 22 for opening and closing the inhale port 21. Fastened to the piston 16 by a connection member, the inhale valve 22 gets elastically bended, depending on a pressure difference between the inside and the outside of the inhale port 21, thus opening and closing the inhale port 21.

An exhale part 30 is configured in a front of a compression chamber C of the cylinder 3, which discharges compressed fluid.

The exhale part 30 includes an inner exhale cover 32 fastened to the cylinder block 4 and provided with an exhale hole 31, an exhale valve 34 elastically suspended in the inner exhale cover 32 by an exhale spring 33, which opens and closes the compression chamber of the cylinder 3, and an outer exhale cover 35 positioned at a regular interval from an outer surface of the inner exhale cover 32 (see FIG. 2).

An exhale pipe 36 is set in the outer exhale cover 35, which discharges compressed fluid to the outside.

A spring sheet 37 is set in the inner exhale cover 32 to prevent against an abrasion, occurred by a repetitive load from the exhale spring 33.

The spring sheet 37 is mounted in one side of the inner exhale cover 32 as a flat plate, not to touch with an edge of the exhale spring 33, and is made of Teflon.

The exhale spring 33 is a conic coil spring to give the elasticity toward a direction that the exhale valve 34 closes the compression chamber C of the cylinder 3. One edge meets the spring sheet 37, and the other is inserted into a safe portion formed in the exhale valve 34.

The conventional linear compressor operates in the following sequence.

In operation of the linear motor 10, the magnet 14 linearly reciprocates due to the magnetic field around the coil 13 and its interaction, its driving force is delivered to the piston 16 through the magnet frame 15. The piston 16 continuously moves back and forth between the exhale valve 34 of the exhale part 30 and the back cover 6.

When the piston 16 moves toward the exhale part 30, the inhale valve 22 becomes closed by the pressure difference of the inhale passage 20 and the compression chamber C.

As the piston 16 moves forward, fluid in the compression chamber C is compressed, allows the exhale valve 34 to be opened by recovering the elasticity of the exhale spring 33, and is discharged to the outside through the inner exhale cover 32 and the outer exhale cover 33.

When the piston 16 moves backward, the inhale valve 22 becomes opened by the pressure difference of the inhale passage 20 and the compression chamber C.

Fluid in the inhale passage 20 of the piston 16 flows into the compression chamber C through the inhale port 21, and the exhale valve 34 closes the compression chamber C by the elasticity of the exhale spring 33.

As the piston 16 moves back and forth, compressing fluid within the compression chamber C and discharging are repeated.

As the exhale valve 34 is repeatedly opened and closed, the repetitive load is given from the exhale spring 33. The spring sheet 37 prevents the edge of the exhale spring 33 from touching with the inner exhale cover 32, and prevents against the abrasion and a transformation of the exhale spring 33 and the inner exhale cover 32, caused by the repetitive load from the exhale spring.

However, in the linear compressor having the conventional exhale part, as the spring sheet 37 is made of Teflon having a weak intensity, the transformation and the abrasion may be occurred due to the excessive load by the exhale spring 33 or by a condition of a high temperature.

Furthermore, as the spring sheet 37 is formed as the flat plate, only one side of the inner exhale cover 32 is protected. In case that the repetitive load is given to a touching portion of an outer circumference of the exhale spring 33 and the inner exhale cover 32, the abrasion and the transformation cannot be avoided.

SUMMARY OF THE INVENTION

Accordingly, it is an aspect of the present invention to provide a linear compressor which is capable of preventing an abrasion and a transformation in a contacting portion of an outer circumference of an exhale spring and an exhale cover, and of improving the durability of the exhale spring and the exhale cover by supporting a load from the exhale spring.

The foregoing and other aspects are achieved by providing the linear compressor, based on the present invention, which comprises the exhale cover where fluid drained through an opening of a cylinder is discharged, an exhale valve set in the exhale cover to open and close the opening, the exhale spring which elastically holds the exhale valve, and a spring sheet which covers an edge of the exhale spring to prevent the edge and the outer circumference of the exhale spring from touching with the exhale cover.

The spring sheet is in the shape of a cap.

The spring sheet is mounted in a side of the exhale cover toward the exhale spring.

The spring sheet includes a plate part touching with the edge of the exhale spring, and a cylinder part protruded in the plate part toward the exhale spring and touching with the outer circumference of the exhale spring.

The spring sheet is made of a metal.

The spring sheet is made of a surface-treated metal.

The spring sheet is made of a plastic.

A supporting member is disposed between the spring sheet and the exhale spring, so as to support the load from the exhale spring.

The supporting member is made of the metal.

The supporting member is a supporting panel set in a side of the spring sheet toward the exhale spring.

In the linear compressor, according to the present invention, as the spring sheet is provided in an inner exhale cover to prevent the edge and the outer circumference of the exhale spring from touching with the inner exhale cover, it prevents that the abrasion and the transformation of the exhale cover and the inner exhale cover, occurred by a touch between them, thereby improving the durability.

As the spring sheet is in the shape of the cap, the outer circumference of the exhale spring is not touched with the inner exhale cover. And, the exhale spring and the inner exhale cover are not abraded, and are not transformed.

As a surface of the spring sheet is made of the surface-treated metal of the high hardness, the abrasion and the transformation by the repetitive load from the exhale spring is protected, and the excessive or local load by the exhale spring is endured, thus it has an effect on improving the durability.

The liner compressor, according to the present invention comprises the spring sheet installed in the inner exhale cover to seat the exhale spring, and the supporting member installed in the spring sheet to support the load from the exhale spring. The excessive or local load from the exhale spring can be endured, thus improving the durability.

The supporting member is made of the metal, and is comprised of the supporting panel installed in the side of the spring sheet toward the exhale spring. Therefore, the load from the exhale spring can be effectively suspended.

BRIEF DESCRIPTION OF THE DRAWINGS

These and other objects and advantages of the present invention will become apparent and more readily appreciated from the following description of the embodiments of the invention, taken in conjunction with the accompanying drawings of which.

DETAILED DESCRIPTION OF THE PREFERRED EMBODIMENT

Figure 1:
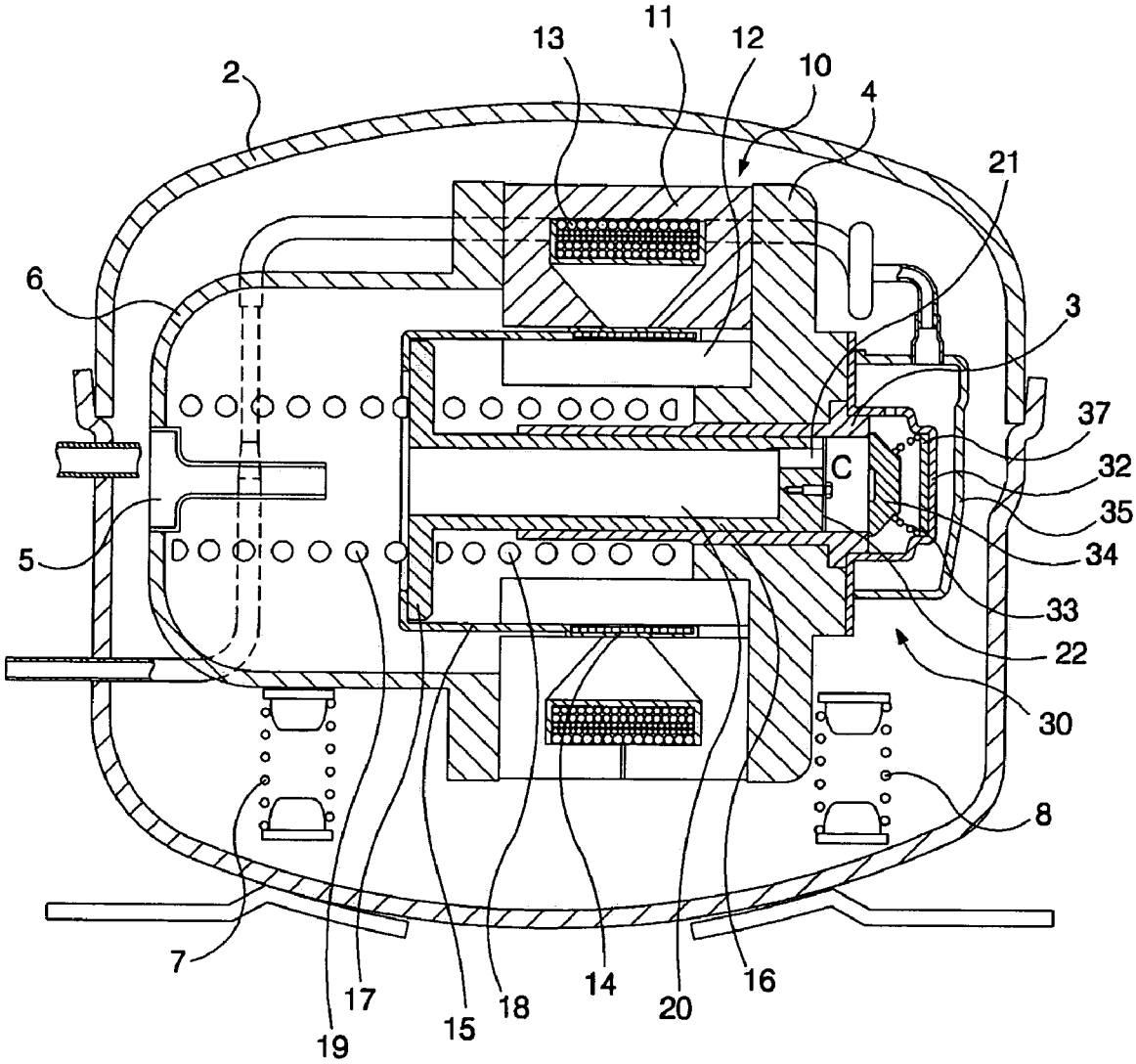
FIG. 1 (Prior Art)
FIG. 1 is a vertically sectional view of a linear compressor, according to the prior art.
Figure 2:
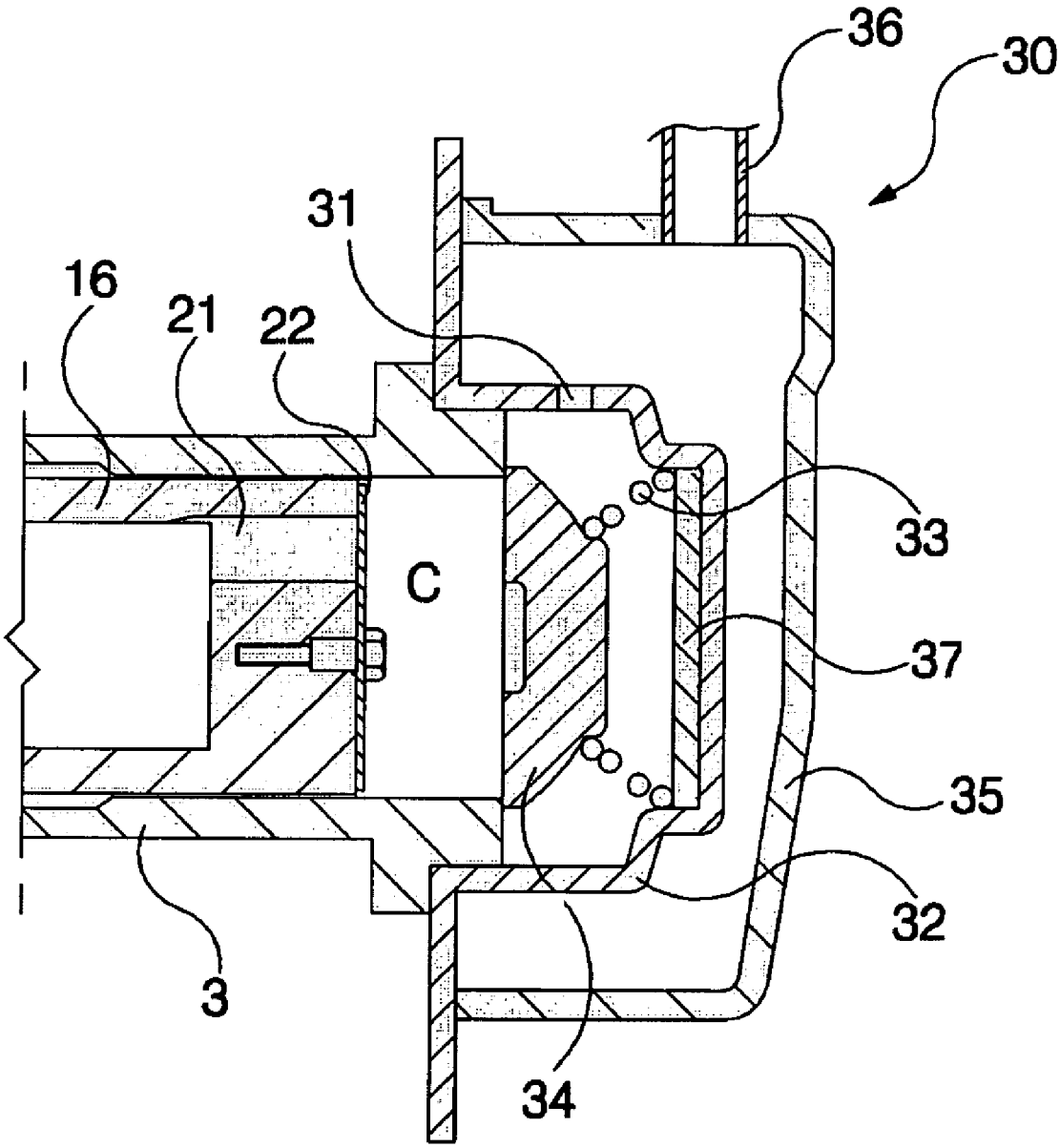
FIG. 2 (Prior Art)
FIG. 2 is a sectional view of a structure of an exhale part of the linear compressor, according to the prior art.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
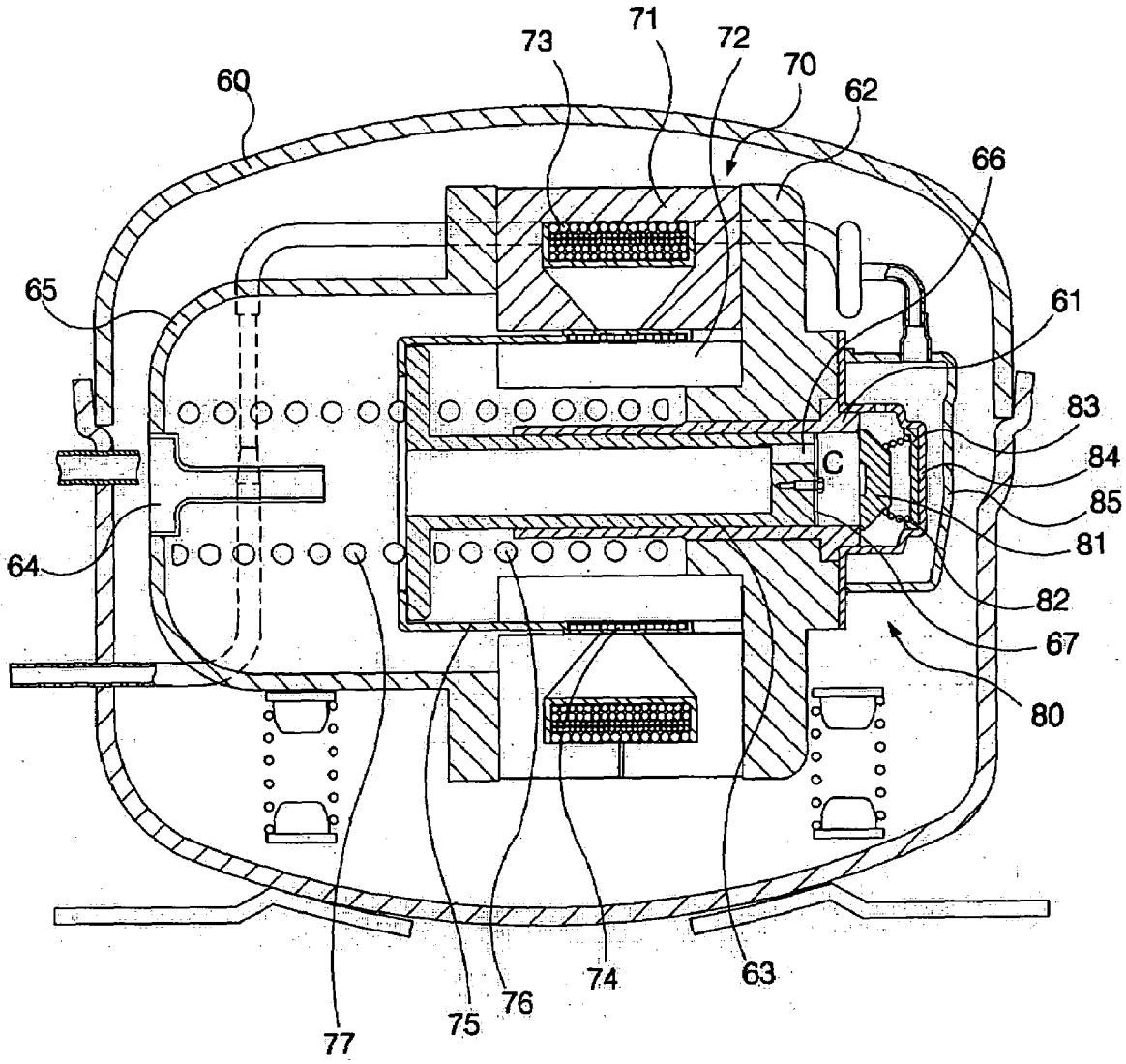
FIG. 3 is a vertically sectional view of the linear compressor, according to a $1^{st}$ embodiment of the present invention.
Figure 4:
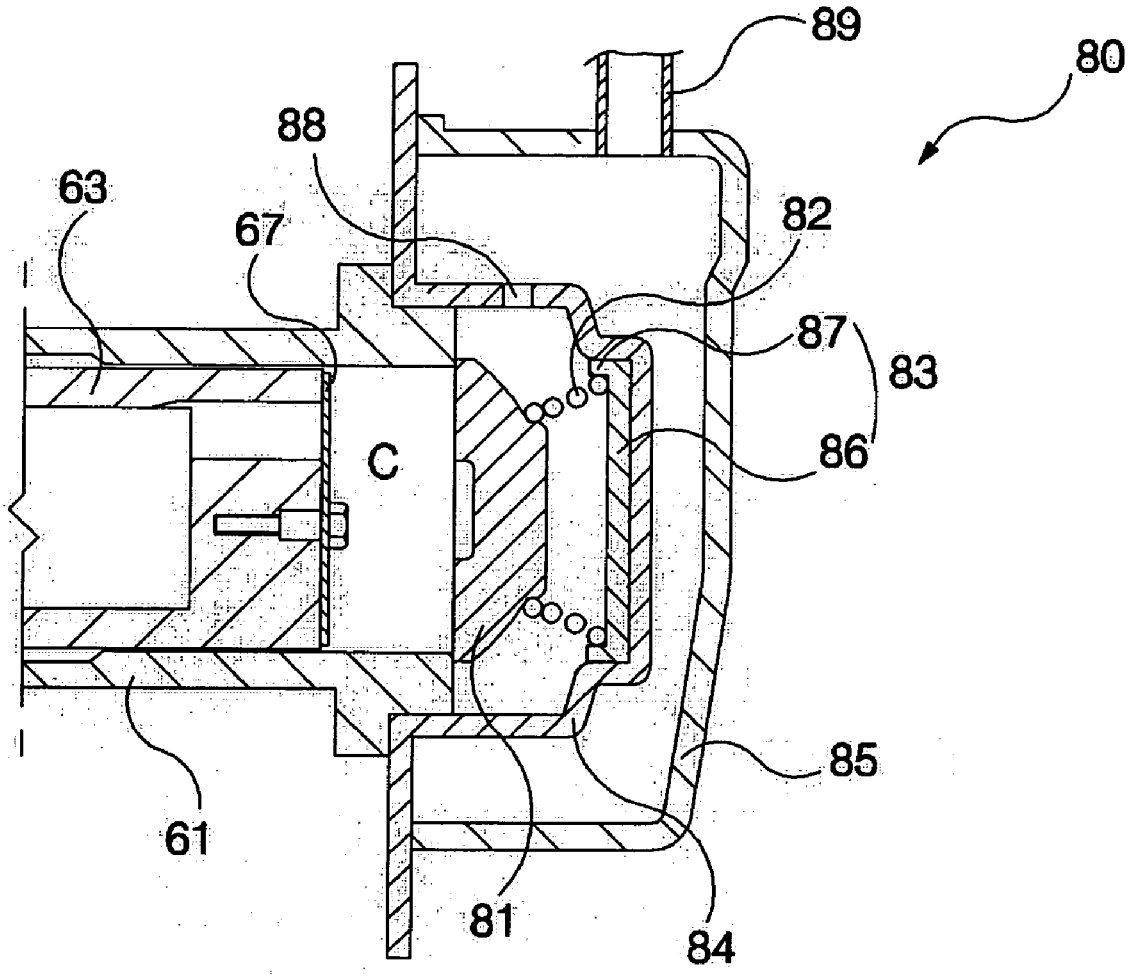
FIG. 4 is an enlarged sectional view of the structure of the exhale part of the linear compressor, according to the $1^{st}$ embodiment of the present invention.

FIG. 3 shows a linear compressor, according to a $1^{st}$ embodiment of the present invention, and FIG. 4 shows a structure of an exhale part of the linear compressor, according to the $1^{st}$ embodiment of the present invention.

As referring to FIGS. 3 to 4, the linear compressor, in accordance with the $1^{st}$ embodiment of the present invention comprises a hermetic casing 60, a linear motor 70 installed in the hermetic casing 60, a cylinder block 62 set in the linear motor 70 and provided with a cylinder 61, a piston 63 which linearly reciprocates in the cylinder 61, by means of the linear motor 70, and the exhale part 80 positioned in a front of an opening of the cylinder 61 to discharge fluid compressed in the cylinder 61.

The cylinder block 62 is mounted in a front of the linear motor 70, while a back cover 65 having an inlet 64 is mounted in a rear of the linear motor 70.

The linear motor 70 is divided by a stationary part and a movable part. The stationary part includes an outer core 71, an inner core 72, and a coil 73 with a magnetic field. The movable part includes a magnet 74 that linearly reciprocates by magnetic force around the coil 73, and a magnetic frame 75 which the magnet 74 is fastened to.

In one end of the cylinder 61, the piston 63 is inserted, and the other end is a cylindrical shape, which is open at both sides, so as to discharge compressed fluid. The piston 63 and the exhale part 80 make a compression chamber C.

The piston 63 is in the shape of a cylinder. In a front, an inhale port 66 for inhaling fluid is placed, and an inhale valve 67 for opening and closing the inhale port 66 is fixed by a connection member like a bolt.

The piston 63 has a flange 68 in its rear, so as to be combined with the magnetic frame 75. As a main spring 76 is disposed between the flange 68 and the cylinder block 62, and a subsidiary spring 77 is disposed between the flange 68 and the back cover 65, so that the piston 63 is elastically supported.

The exhale part 80 includes an exhale cover which discharges fluid drained from the opening of the cylinder 61, an exhale valve 81 equipped in the exhale cover to open and close the opening, an exhale spring 82 which elastically supports the exhale valve 81, and a spring sheet 83 which prevents an edge and an outer circumference of the exhale spring 82 from touching with the exhale cover and from being abraded, by covering the edge of the exhale spring 82.

The exhale cover includes an inner exhale cover 84 arranged in the opening of the cylinder 61, and an outer exhale cover 85 arranged in an outer surface of the inner exhale cover 84. The exhale valve 81 and the spring sheet 83 are placed in the inner exhale cover 84.

The exhale spring 82 is a conic coil spring to give the elasticity toward a direction that the exhale valve 81 closes the compression chamber C of the cylinder 61. Its one end is seated in the exhale valve 81, and the other is seated in the spring sheet 83.

The spring sheet 83 is in the shape of a cap, and is comprised of a plate part 86 where the edge of the exhale spring 82 is touched, and a cylinder part 87 where the outer circumference of the exhale spring 82 is touched, by being protruded in the plate part 86 toward the exhale spring 82.

The spring sheet 83 is made of a metal to prevent an abrasion by a repetitive load from the exhale spring 82. Its surface is treated with the metal of the high hardness to support the excessive load given from the exhale spring 82.

It is desirable to combine the spring sheet 83 and the inner exhale cover 84, by means of connecting a protrusion and a groove, of pushing, or of adhering.

An exhale hole 88 is formed in the inner exhale cover 84, so as to discharge fluid to the outer exhale cover 85.

The outer exhale cover 85 is spaced apart from the inner exhale cover 84 by predetermined distance, in order to reduce a noise, occurred when fluid is discharged, and is connected to an exhale pipe 89 where fluid is discharged.

A process of the linear compressor having the exhale part, according to the $1^{st}$ embodiment of the present invention is described in the following.

When the linear motor 70 is in operation, the piston 63 linearly reciprocates within the cylinder 61.

When the piston 63 moves forward, the exhale valve 81 becomes opened by the pressure of fluid compressed within the cylinder 61, and compressed fluid is discharged to the inner exhale cover 84.

Fluid is discharged to the outer exhale cover 85 through the exhale hole 88 of the inner exhale cover 84, prior to being discharged to the outside through the exhale pipe 89.

As the exhale valve 81 is held by the exhale spring 82, the exhale spring 82 is compressed by opening the exhale valve 81.

As the exhale valve 81 is repeatedly opened and closed, the exhale spring gives the repetitive load to the inner exhale cover 84.

On this occasion, the edge of the exhale spring 82 is touched with the plate part 86 of the spring sheet 83, and the outer circumference of the exhale spring 82 is touched with a circumference of the cylinder part 87 of the spring sheet 83. Therefore, the abrasion and a transformation of the exhale spring 82 and the inner exhale cover 84 can be prevented, which is caused by the repetitive load from the exhale spring 82.

As the spring sheet 83 passes surface treatment with the metal of the high hardness, the transformation and the abrasion occurred from the excessive or local load given from the exhale spring 82 can be prevented, furthermore, the transformation occurred from a high temperature can be prevented.

Figure 5:
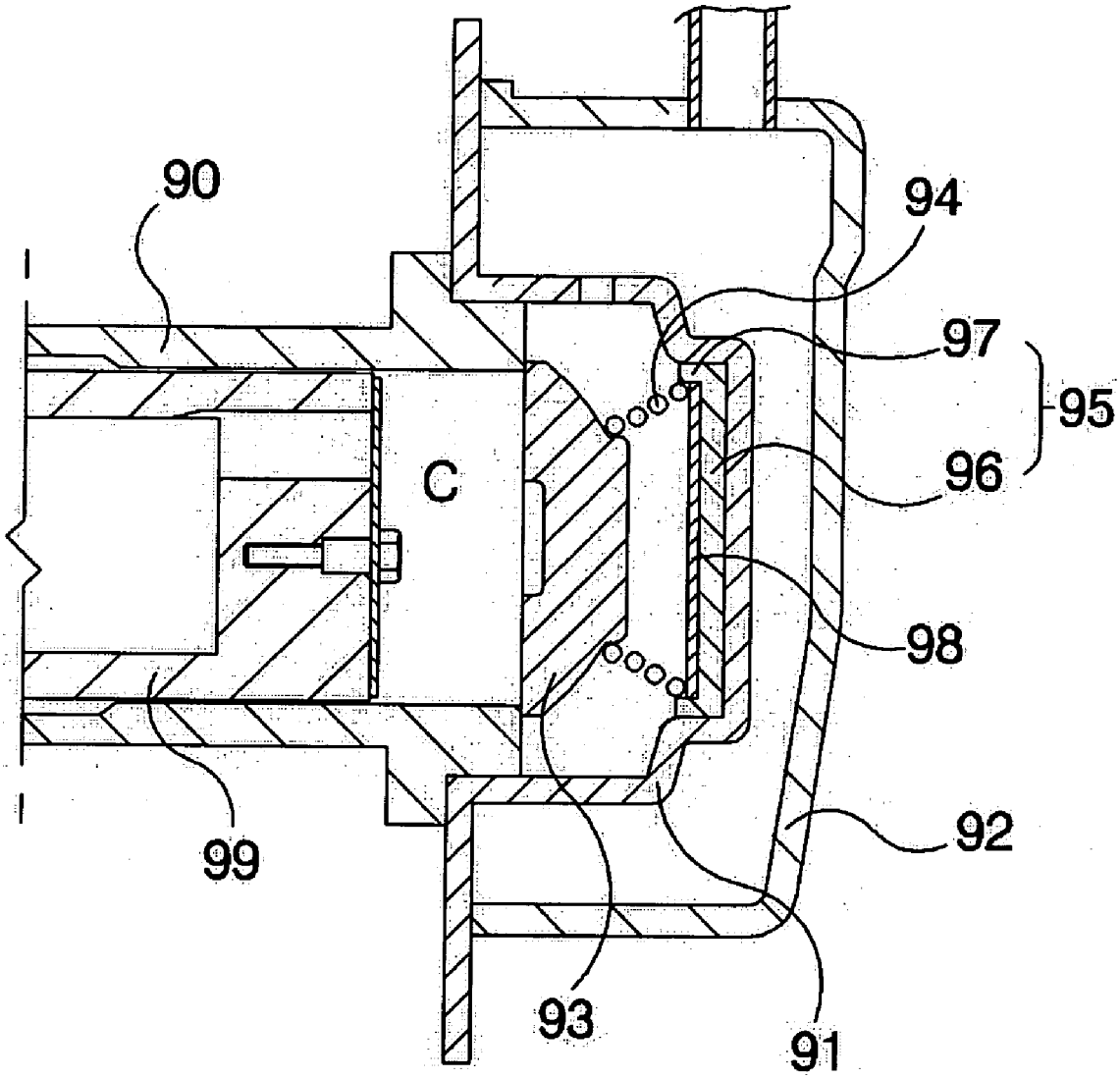
FIG. 5 is an enlarged sectional view of the structure of the exhale part of the linear compressor, according to a $2^{nd}$ embodiment of the present invention.

FIG. 5 shows the exhale part of the liner compressor, according to a $2^{nd}$ embodiment of the present invention.

As referring to FIG. 5, the structure of the exhale part of the linear compressor, according to the $2^{nd}$ embodiment of the present invention comprises an inner exhale cover 91 where fluid drained from an opening of a cylinder 90 is discharged, an outer exhale cover 92 positioned in an outer surface of the inner exhale cover 91, an exhale valve 93 set in the inner exhale cover 91 to open and close the opening, an exhale spring 94 which elastically upholds the exhale valve 93, a spring sheet 95 equipped in the inner exhale cover 91 to seat the exhale spring 94, and a supporting member 98 mounted in the spring sheet 95 to hold the load from the exhale spring 94.

A piston 99 linearly reciprocates in the cylinder 90 by a linear motor (not shown), which compresses fluid within the cylinder 90.

The spring sheet 95 is in the shape of the cap, so as to prevent an edge and an outer circumference of the exhale spring 94 from touching with the inner exhale cover 91.

The spring sheet includes a plate part 96 where the edge of the exhale spring is touched, and a cylinder part 97 where the outer circumference of the exhale spring 94 is touched, by being protruded in the plate part 96 toward the exhale spring 94.

The supporting member 98 is a discal supporting panel mounted in a side of the spring sheet 95 toward the exhale spring 95.

The spring sheet 95 is made of a plastic, and the supporting member 98 is made of the metal. To endure the excessive load, a material for the lower abrasion is used, i.e. a steel spring sheet.

The supporting member 98 is desired to be fastened to the spring sheet 95 by pushing, or by adhering.

The supporting member 98 can prevent the abrasion and the transformation, occurred from the excessive or local load transmitted from the exhale spring 94, and can endure the high temperature. And, the spring sheet 95 can prevent the abrasion of the outer circumference of the exhale spring 94 and the inner exhale cover 91.

As apparent from the above description, the linear compressor having the exhale part of the present invention provides the spring sheet placed in the inner exhale cover, so as to prevent the edge and the outer circumference of the exhale spring from touching with the inner exhale cover, resulting in preventing the exhale spring and the inner exhale cover from being abraded and from being transformed, when the exhale spring and the inner exhale cover are touched. The durability can be enhanced.

As the spring sheet is in the shape of the cap, the outer circumference of the exhale spring is not touched with the inner exhale cover. It can prevent the abrasion and the transformation of the exhale spring and the inner exhale cover.

As the surface of the spring sheet is treated with the metal of the high hardness, the abrasion and the transformation by the repetitive load from the exhale spring is protected, the excessive or local load by the exhale spring can be endured, thus improving the durability.

The linear compressor having the exhale part of the present invention comprises the spring sheet equipped in the inner exhale cover to seat the exhale spring, and the supporting member equipped in the spring sheet to support the load from the exhale spring. The linear compressor can endure the excessive or local load given from the exhale spring, thus improving the durability.

The supporting member is made of the metal, and is comprised of the supporting panel mounted in the side of the spring sheet toward the exhale spring. The supporting member can effectively support the load transmitted from the exhale spring.

Although a few embodiments of the present invention have been shown and described, it would be appreciated by those skilled in the art that changes may be made in this embodiment without departing from the principles and spirit of the invention, the scope of which is defined in the claims and their equivalents.

The present disclosure relates to subject matter contained in Korean Application No. 10-2004-0079942, filed on Oct. 7, 2004, the contents of which are herein expressly incorporated by reference in its entirety.

What is claimed is:

1. A linear compressor comprising:

an inner exhale cover where fluid drained from an opening of a cylinder is discharged;

an outer exhale cover spaced apart from an outer surface of the inner exhale cover;

an exhale valve set in the inner exhale cover to open and close the opening of the cylinder;

an exhale spring provided between the exhale valve and a side of the inner exhale cover to support the exhale valve elastically; and a spring sheet fixed to the side of the inner exhale cover, wherein the spring sheet is configured to cover at least an edge of the exhale spring such that the edge of the exhale spring is prevented from being touched by the inner exhale cover.

2. The linear compressor as set forth in claim 1, wherein the spring sheet is formed in the shape of a cap.

3. The linear compressor as set forth in claim 1, wherein the spring sheet includes a plate part where the edge of the exhale spring is touched, and a cylinder part where at least the outer circumference of the edge of the exhale spring is touched, said cylinder part being protruded in the plate part toward the exhale spring.

4. The linear compressor as set forth in claim 1, wherein the spring sheet is made of a plastic.

5. The linear compressor as set forth in claim 4, wherein a supporting member is disposed between the spring sheet and the exhale spring, so as to hold a load from the exhale spring.

6. The linear compressor as set forth in claim 5, wherein the supporting member is made of a metal.

7. The linear compressor as set forth in claim 6, wherein the supporting member is a supporting panel mounted in a side of the spring sheet toward the exhale spring.

8. A linear compressor comprising:

a hermetic casing;

a linear motor installed in the hermetic casing;

a cylinder block set in the linear motor and provided with a cylinder;

a piston which linearly reciprocates in the cylinder, by means of the linear motor; and an exhale part located in a front of an opening of the cylinder to discharge fluid compressed within the cylinder, wherein the exhale part includes:

an inner exhale cover where fluid drained from an opening of the cylinder is discharged;

an outer exhale cover spaced apart from an outer surface of the inner exhale cover;

an exhale valve set in the inner exhale cover to open and close the opening of the cylinder;

an exhale spring provided between the exhale valve and a side of the inner exhale cover to support the exhale valve elastically; and a spring sheet fixed to the side of the inner exhale cover, the spring sheet being configured to cover at least an edge of the exhale spring such that the edge of the exhale spring is prevented from being touched by the inner exhale cover.

9. The linear compressor as set forth in claim 8, wherein the spring sheet is formed in the shape of a cap.

10. The linear compressor as set forth in claim 8, wherein the spring sheet includes a plate part where the edge of the exhale spring is touched, and a cylinder part where at least the outer circumference of the edge of the exhale spring is touched, said cylinder part being protruded in the plate part toward the exhale spring.

11. The linear compressor as set forth in claim 8, wherein the spring sheet is made of a plastic.

12. The linear compressor as set forth in claim 11, wherein a supporting member is disposed between the spring sheet and the exhale spring, so as to hold a load from the exhale spring.

13. The linear compressor as set forth in claim 12, wherein the supporting member is made of a metal.

14. The linear compressor as set forth in claim 13, wherein the supporting member is a supporting panel mounted in a side of the spring sheet toward the exhale spring.

* * * * *